United States Patent [19]

Balsamico et al.

[11] Patent Number: 4,878,523

[45] Date of Patent: Nov. 7, 1989

[54] ICE MEASURING AND DISPENSING MACHINE

[76] Inventors: William A. Balsamico, 1722 Marion Dr.; Walter J. Minnick, Jr., 1732 Marion Dr., both of North Huntingdon, Pa. 15642

[21] Appl. No.: 177,149

[22] Filed: Apr. 4, 1988

[51] Int. Cl.[4] ..... B65B 3/16

[52] U.S. Cl. ..... 141/114; 222/197; 181/200; 141/98; 141/71; 221/200

[58] Field of Search ..... 141/114, 10, 71, 72, 141/250, 98; 221/200; 181/198, 200, 205

[56] References Cited

U.S. PATENT DOCUMENTS

| | | | |
|---|---|---|---|
| 1,965,741 | 7/1934 | Jameson | 222/197 |
| 2,037,555 | 4/1936 | Zwoyer | 222/197 |
| 2,888,962 | 6/1959 | Ammon | 222/197 X |
| 3,101,872 | 8/1963 | Dickinson | 222/197 |
| 3,269,612 | 8/1966 | Bode | 222/197 |
| 3,320,879 | 5/1967 | Edwards et al. | 222/196 X |
| 3,955,718 | 5/1976 | Van Holdt et al. | 222/197 |
| 4,025,122 | 5/1977 | Diemart | 222/197 X |
| 4,081,109 | 3/1978 | Kugle et al. | 222/197 |
| 4,356,884 | 11/1982 | Mortimer | 181/200 |
| 4,744,714 | 5/1988 | Cross, Jr. et al. | 222/197 |

*Primary Examiner*—Ernest G. Cusick
*Attorney, Agent, or Firm*—James L. Sherman

[57] ABSTRACT

An improved ice measuring and dispensing machine is of the type which includes an ice supply hopper, a housing having three measuring and dispensing chambers which continuously rotate about a vertical axis, and a discharge chute. Each of the chambers rotates beneath the supply hopper to receive ice by gravity flow therefrom. Each of the chambers filled with ice from the ice supply hopper rotates over the discharge chute to discharge the ice therein by gravity flow down the discharge chute into an ice bag. The improvement includes the rotating housing having a cylindrical wall which partially defines each of the chambers. A hammer device is reciprocated toward and away from the cylindrical wall to cause the head thereof to make repeated, jarring contact with the cylindrical wall to vibrate the chambers and thus prevent the collection or bridging of ice therein.

12 Claims, 2 Drawing Sheets

ICE MEASURING AND DISPENSING MACHINE

BACKGROUND OF THE INVENTION

1. Field of the Invention.

This invention relates to an ice measuring and dispensing machine and, more specifically, to such a machine which has been improved to make it more reliable and efficient of the primary purpose of rapidly and effectively filling a plurality of plastic bags for eventual sale at retail outlets. The improvement includes providing an attachable device to an existing ice measuring and dispensing machine to insure the accurate measurement of the desired quantity of ice and that the exact quantity is then properly delivered to the plastic bags.

2. Description of the Prior Art.

A significant aspect of the ice processing business includes the ability to measure and dispense a predetermined quantity of ice into plastic bags for eventual retain distribution. One series of extensively used and accepted ice measuring and dispensing machines are made by the Matthiesen Manufacturing Company of San Antonio, Texas. Each of the series of ice measuring and dispensing machines is different in order to satisfy the different volumetric requirements of various retail outlets. However, each of the series of ice measuring and dispensing machines includes common elements and features so that the improvement of the present invention is equally and alternatively applicable to any one of the series of machines. Specifically, the Matthiesen Machine Model VLS-35 is rated for the filling of three to five pound bags of ice. Matthiesen VLS-510 is rated for filling five to ten pound bags of ice. Finally, Matthiesen VLS-815 is capable of filling eight to fifteen pound bags of ice.

Each of these machines operates in a similar manner and includes features for varying the volume and quantity of ice which is to be dispensed into the plastic bags. It is essential that the retail customer be provided the promised quantity of ice when the bag is eventually purchased.

Although there has been general satisfaction with the basic machines, some significant problems have occurred. Depending on the environmental conditions, some bridging or collecting of ice within the chambers may occur which will prevent the ice from properly being discharged to the discharge chute by gravity flow. Since this problem has been recognized for some time, there has been an effort made to provide additional means for the basic machine to insure complete discharge of all of the ice from the measuring and dispensing chambers. Specifically, a biased flap device located above the discharge chute has been used in an effort to force all of the the ice from the chamber into the discharge chute. However, the flap device has not been found to be reliable and bridging and collection of ice still frequently occurs.

SUMMARY OF THE INVENTION

The improved ice measuring and dispensing machine of the present invention is of the type which includes an ice supply hopper, a housing having at least three measuring and dispensing chambers continuously rotating about a vertical axis, and a discharge chute. Each of the chambers rotates beneath the ice supply hopper to receive the ice by gravity flow therefrom. Each chamber filled with ice from the ice supply hopper rotates over the discharge chute to discharge the ice therein by gravity flow down the discharge chute into an ice bag. The improvement includes the rotating housing having a cylindrical wall which partially defines each of the chambers. There is included means for selectively vibrating the cylindrical wall during the rotation of the housing. The means for selectively vibrating includes a hammer device which is reciprocated toward and away from the cylindrical wall to cause a head at a first end thereof to make repeated, jarring contact in a continuous band region of the cylindrical wall.

It is, therefore, an object of the present invention to insure that the quantity of ice measured by the chambers is completely discharged for receipt in the ice bags.

It is a further object of the present invention to provide the ice measuring and dispensing machine of the type described which further includes means for selectively vibrating a wall of the ice supply hopper to insure that a full quantity of ice is provided to the chambers for eventual supply to the ice bags.

Additional objects of the invention together with the features contributing thereto and the advantages accruing therefrom will be apparent from the following description when read in conjunction with the drawings.

DETAILED DESCRIPTION OF THE PREFERRED EMBODIMENT

Figure 1:
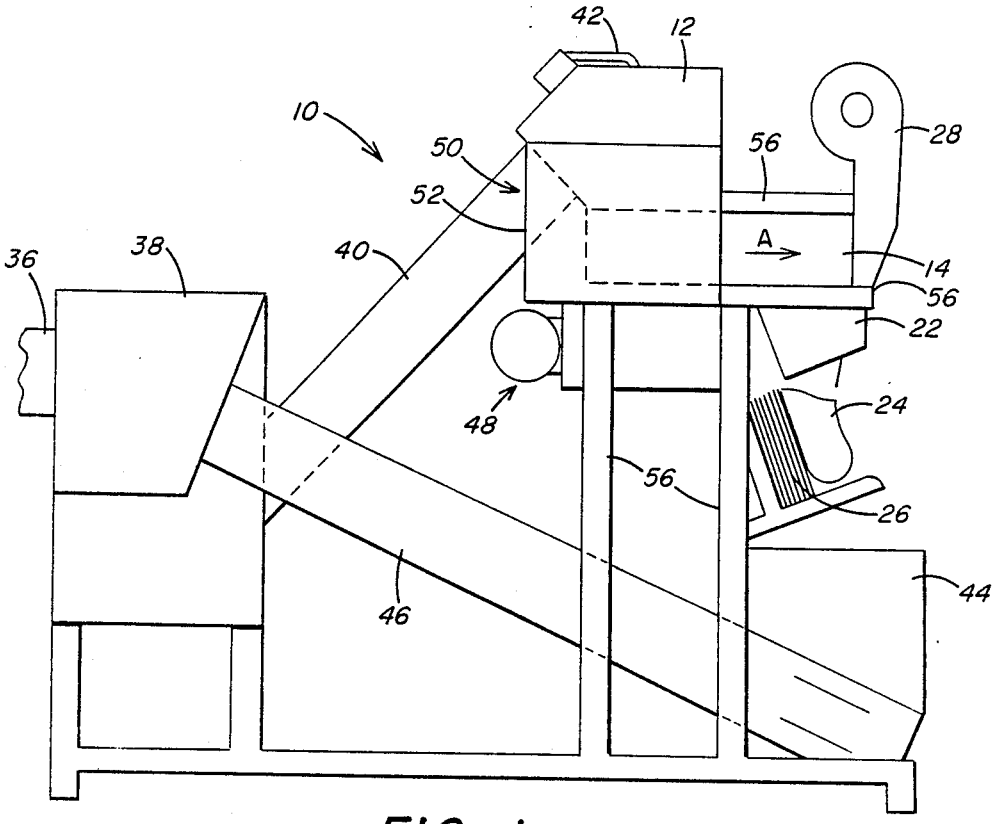
FIG. 1 is an elevational view of the basic machine including various features of the invention.
Figure 3:
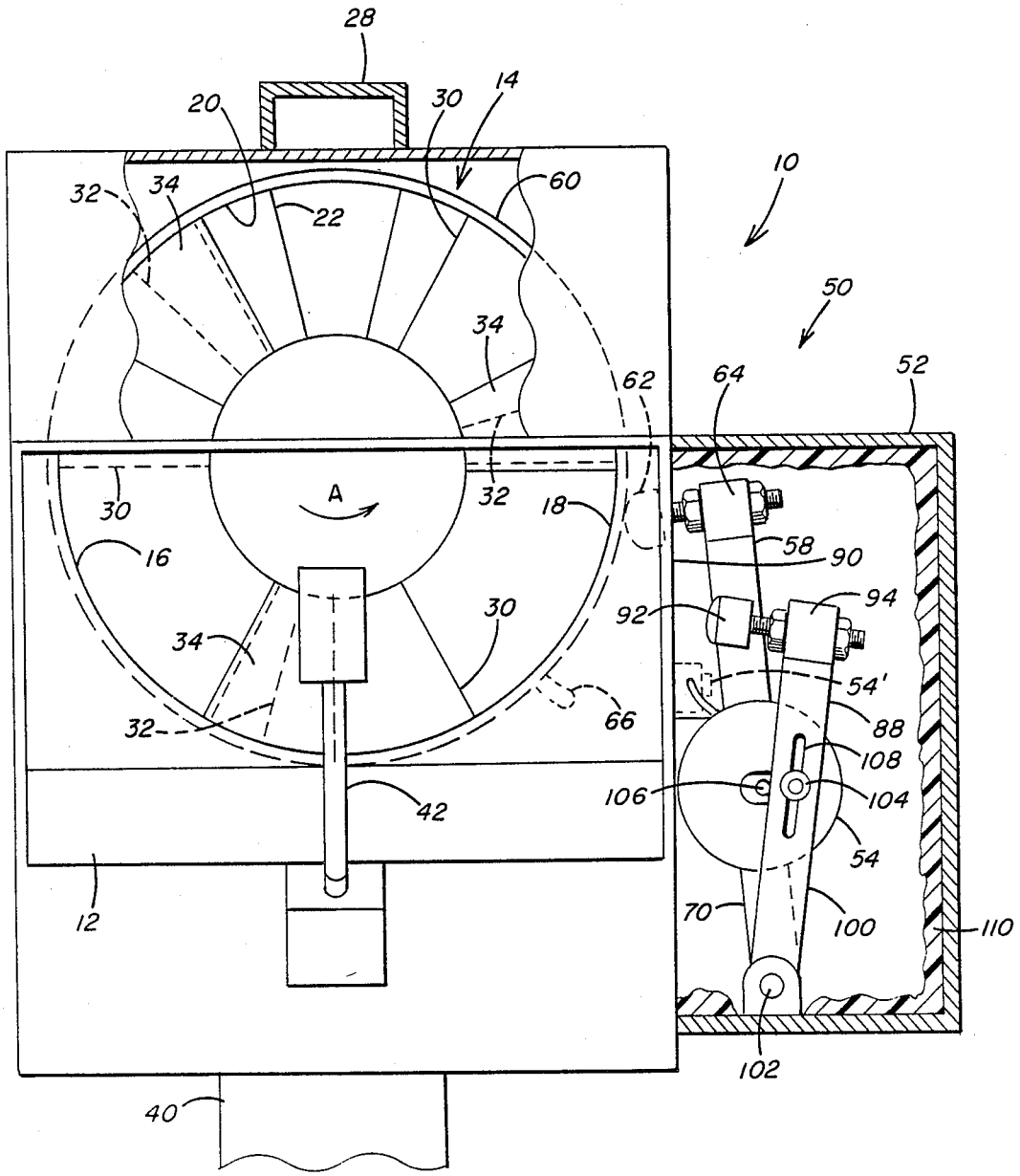
FIG. 3 is a top view of the machine of FIG. 1 with fragmentary portions to reveal additional details of the basic machine.

As seen in FIGS. 1 and 3, the basic ice measuring and dispensing machine 10 includes an ice supply hopper 12 and a rotating housing 14 having three measuring and dispensing chambers 16, 18, 20. The rotation of the housing 14 about a vertical axis in a direction as indicated by the arrow A is continuous to cause each of the chambers 16, 18, 20 to pass beneath the ice supply hopper 12 to receive ice by gravity flow therefrom. After each chamber 16, 18, 20 is in turn filled with ice, it continues to rotate from beneath the ice supply hopper 12 to pass above a discharge chute 22. As each respective chamber 16, 18, 20 passes over the discharge chute 22, the ice therein is caused to flow by gravity flow into the discharge chute 22.

The measured quantity of ice is received within a plastic bag 24. The plastic bag 24 is the next plastic bag in an array or stack 26 of plastic bags which are positioned as seen in the machine 10 for the continuous bag filing operation. When the bag 24 is full of the ice from the discharge chute 22, it is removed by an operator for closure and sealing at an adjacent work station (not shown). A continuously operating blower 28 of the machine 10 opens the next bag from the array 26 to properly position it for the receipt of ice from the next chamber to pass above the discharge chute 22.

As thus described, the operation of the ice measuring and dispensing machine 10 appears to be quite simple. Additionally, because of the slippery characteristics of ice, one would expect that a configuration which tends to rely on gravity flow would also be extremely reliable. However, it has been found that the reliability of the machine 10 significantly depends on the temperature and humidity of the area in which the machine 10 is located. For the comfort of the operator of the machine 10, the environmental conditions cannot always be as cold or dry as might be desired for the most effective operation of the machine 10.

To fully understand some of the problems encountered, it is appropriate to further explain in detail the ice making process and operation of the machine 10. Generally, ice is produced in one of three forms depending on the particular equipment owned and operated by the ice processor utilizing the machine 10. The eventual shape of the ice is either irregular, cubical, or tubular. Depending on whether the pieces of ice are irregular, cubical or tubular, a predetermined volume of the pieces will vary in weight. As a result, each particular ice processor will purchase bags for the type of ice he produces to provide an overall weight according to the demands of his particular retail outlets. In order to accurately fill the desired bag with the particular type of ice being produced, each of the chambers, 16, 18, 20 includes means for varying the volume. Specifically, each chamber 16, 18, 20 includes a rear side wall 30 and a leading side wall 32. Variation in the volume is obtained by an L-shaped element 34 which can be accurately, angularly positioned relative to the leading wall 32 to selecte any desired volume for the chamber 16, 18, 20. The specific angular position of the element 34 is thus different for each type of ice even though the desire eventual weight per bag would be almost identical.

With such an accurate measurement of the volume of ice to be discharged to a bag, one might expect that there would be little opportunity for the final quantity of ice in the bag to be inaccurate. However, the entire measuring and dispensing process assumes that each of the chambers 16, 18, 20 will be completely filled when passing beneath the ice supply hopper 12 and that each chamber 16, 18, 20 will be completely emptied of ice at the discharge chute 22 during each revolution of each chamber. With certain environmental conditions, accuracy is obtained throughout extended use of the machine 10. However, as mentioned above, if the environmental conditions are not proper, bridging of the ice pieces can occur within the ice supply hopper 12 to prevent complete filling of the chambers passing there beneath. Additionally, bridging of the ice pieces within the respective chambers 16, 18, 20 can also occur as the chambers pass above the discharge chute 22 to prevent all of the ice therein from being dropped by gravity flow into the discharge chute 22. Failure to discharge all of the ice pieces into a particular bag would prevent the bag from being supplied to a retail outlet because of failure to have the proper weight of ice in the bag. Numerous regulations and laws for consumer protection prevent the retail outlets from selling any ice bags which do not contain the proper, indicated weight of ice therein.

The entire ice bag filling process includes additional elements of interest. When the pieces of ice are produced in a refrigeration unit or the like, they are transferred by a feed screw 36 to an intermediate hopper 38. Since the overall amount of ice being supplied to the bags 24 depends on the particular bag size and the type of ice, the machine operator monitors the volume of ice in the intermediate hopper 38 to insure that there is a sufficient quantity for transfer to the ice supply hopper 12. A simple on/off switch controlling the feed screw 36 enables the operator to periodically determine that a proper quantity is being maintained within the intermediate hopper 38. With an adequate supply of ice in the intermediate hopper 38, a supply screw 40 is capable of transferring a sufficient quantity to fill the ice supply hopper 12. Because of the location and size of the ice supply hopper 12, there is included and automatic sensing means 42 at the top thereof to insure that the hopper 12 remains full. The sensing means 42 is raised when the level of ice therein reaches the top of the hopper 12 to activate a contact switch to discontinue power to the supply screw 40. When the level of ice within the supply hopper 12 is lowered by the continued filling of the chamber 16, 18, 20, the sensing means 42 will be lowered to provide a signal for reactivation of the supply screw 40.

Obviously, if all of the ice in the supply hopper 12 is free to move about the interior thereof, an adequate supply of ice should always be available for the chambers 16, 18, 20. However, as mentioned above, there are some environmental conditions which will cause bridging and collecting of the ice pieces within the hopper 12 to prevent them from freely falling into the chambers 16,18,20. If the bridging is serious, it could also prevent the sensing means 42 from determining the actual quantity of ice within the hopper 12 to prevent the supply screw 40 from providing and adequate amount of ice to the supply hopper 12.

Even 9if one were to assume that the supply hopper 12 contained an adequate quantity of ice pieces which were free to fill each of the chambers 16, 8, 20, the environmental problems have been found to periodically cause bridging or collection of ice pieces within the respective chambers 16, 18, 20 to prevent the full discharge of the ice pieces into the discharge chute 22. As seen in FIG. 3, the chamber 20 has partially passed over the smaller discharge chute 22 and is in a position for the release of most of the ice pieces therein. However, if some bridging or collection of ice pieces occurs at the forward end of the chamber 20 adjacent the device 32, once the ice is rotated past the discharge chute 22, it will remain within the chamber 20 rather than being properly discharged to the plastic bag 24.

Many of the machines 10 can include an additional feature to prevent loss of ice if any one or more of the plastic bags. 24 is defective or ruptures during the filling process. Beneath the bags 26 and the filling bag 24 is spill hopper 44. Ice falling into the spill hopper 44 is returned to the intermediate hopper 38 by a return screw 46.

In order to fully appreciate the complications and problems which can occur if several bags are improperly filled during the filling process, one need only understand how fast the bags are filled by the machine 10. The ice measuring and dispensing machine 10 includes a housing drive motor and gearing means 48 to rotate the housing 14 at a speed of nine revolutions per minute. With a speed of nine revolutions per miniute, twenty-seven bags are filled per minute. Filling the bags at such a rate requires constant activity and attention by the operator to simply remove each of the bags when filled, to properly close the bag after it is filled and to place the filled, closed bag on a conveyer for eventual collection and transportation. At a rate of twenty-seven bags per minute the operator could easily fail to recognize if some of the bags are not entirely full and would be unable to correct any problems in the area of the ice bridging while the machine 10 continues to operate. Improperly filled bags caused by the bridging of ice in the supply hopper 12 or the chambers 16, 18, 20 will completely disrupt the process and result in lost bags because of their being improperly filled.

Unfortunately, the environmental conditions which can produce bridging and disruption of bag filling tend to occur more in the summer and under humid conditions when there is a greater overall demand for ice. Accordingly many ice processors have found that the greater problems seem to occur when the need for continuous, effective filling is most important and critical.

Figure 2:
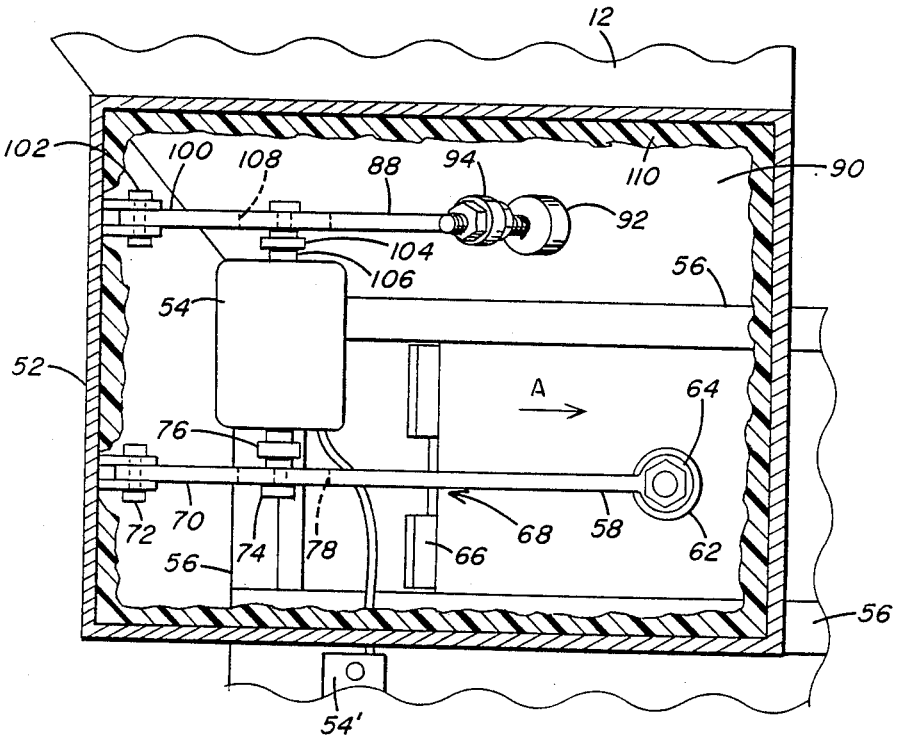
FIG. 2 is a fragmentary view of the preferred vibrating means partially in section.

Accordingly, the present invention is intended to insure that the machine 10 can continuously and effectively operate independent of the environment conditions which can tend to cause ice bridging or collection. Specifically, a vibrating device 60 is capable of being used on each of the models of the machines 10 as mentioned above. As best seen in FIGS. 2 and 3, the vibrating device 50 includes a cabinet 52 and a motor 54 which can be directly and firmly secured to the framing 56 of any one of the machines 10. The motor 54 can be powered from a separate source to operate independently of the overall operation of the machine 10. In other words, the vibrating device 50 need only be utilized when the environmental conditions are such that bridging or collection of the ice which permits proper filling might occur. Specifically, the motor 54 may be operated at a predetermined revolutions per minute which will be discussed in detail hereinbelow, but could also be configured to include a speed varying mechanism 54' to allow the operator to vary and select the rate of vibration to ultimately insure proper filling even in the most extreme environmental conditions.

The preferred motor 54 is intended to produce a vibration of both the chambers 16, 18, 20 and the ice supply hopper 12. In some operating environments, ice bridging or collection tends to primarily occur within the chambers 16, 18, 20 so that only vibration of the chambers may be sufficient.

To specifically vibrate the chambers 16, 18, 20 a hammer device 58 is reciprocated toward and away from a cylindrical wall 60 of the housing 14. The cylindrical wall 60 partially defines each of the chambers 16, 18, 20 so that vibration of the wall 60 would in turn produce vibration within each of the chamber 16, 18, 20. A head 62 located at the first end 64 of the hammer device 58 is caused by the motor 54 to make repeated contact along a continuous band region of the cylindrical wall 60 throughout rotation of the housing 14. In the basic machine 10, the cylindrical wall 60 of the housing 14 is made of an elongated piece of sheet material which is bent to form a cylinder with the ends thereof joined at a seam 66. Consequently, in order to provide a continuous band region of the cylindrical wall 60 for repeated contact by the head 62, a portion of the seam 66 must be removed as shown at 68.

The reciprocation of the hammer device 58 occurs about the second end 70 thereof which is pivotally mounted at a fitting 72 secured to the cabinet 52. Reciprocation about the fitting point 72 is accomplished by a crank arm 74 secured to one end 76 of a shaft of the motor 54. The rotating crank arm 74 acts within a slot 78 located intermediately of said hammer device 58.

A similar configuration is used to produce vibration of the ice supply hopper 12. A second hammer device 88 is aligned to produce vibration of a side wall 90 of the hopper 12 by the repeated and jarring contact with the head 92 at the first end 94 of the hammer device 88. The vibrating machine 50 and thus the second hammer device 88 are preferably located adjacent the side wall 90 because most bridging tends to occur to that side of the ice supply hopper 12 due to the rotation of the housing 14 in that direction. Reciprocation of the device 88 is produced by the second end 100 being pivotally mounted at a fitting 102 which is secured to the cabinet 52. Another crank arm 104 is secured to the other end 106 of the through shaft of the motor 54. The crank arm 104 again operates on a slot 108 located intermediate of the hammer device 88. The crank arms 74 and 104 are angularly displaced one from the other by 180 degrees to provide an even load for the operation of the motor 54.

As mentioned above, one significant feature of the vibrating means 50 is the ability to be conveniently adapted for use on existing ice measuring and dispensing machines 10. Because of minor differences in machine configurations, it is desirable for the heads 62, 92 to be adjustable for proper contact with their respective walls which may vary in location relative to the frame 56. Additionally, the heads 62, 92 are provided a coating of synthetic material to prevent metal on metal contact. The synthetic material should not be too resilient since it is the primary purpose of the heads 62, 92 to create jarring contact with the respective walls of the machine 10. Since the jarring contact will produce a significant amount of noise, the cabinet 52 is preferably insulated with sound insulation material 110 for the benefit for the operator. It should be kept in mind that the entire machine 10 is quite noisy during normal operation but it may still be desirable to keep the additional noise level created by the vibrating device 50 to a minimum.

After experimentation under a wide range of environment conditions, it has been found that a recommended rate of vibration is produced when the motor 54 is run at 450 RPM. Such a rate appears to virtually eliminate all bridging and collection of ice pieces and to allow continued, effective and reliable operation of the ice measuring and dispensing machine 10.

It should be clear that any number of alterations or modifications could be made to the improved vibrating means 50 without departing from the scope of the invention as claimed. For example, a spring element may be added between the intermediate portion of the hammer devices and the first ends thereof. The spring element should not be too resilient to prevent the desired jarring contact by the head. However, some resilience in the hammer device might tend to simplify head adjustment and dampen the work load on the motor 54.

We claim:

1. An improved ice measuring and dispensing machine of the type which includes an ice supply hopper, a rotating housing having a vertical axis and at least three measuring and dispensing chambers continuously rotating about said vertical axis at a predetermined speed, and a discharge tube; each of said chambers rotating beneath said ice supply hopper to receive said ice by gravity flow therefrom; said each chamber filled with said ice from said ice supply hopper rotating over said discharge chute to discharge said ice therein by gravity flow down said discharge chute into an ice bag; said improvement comprising:

said rotating housing having a cylindrical wall which partially defines each of said chambers;

said cylindrical wall having an outer surface including a continuous cylindrical band region;

means for selectively vibrating said cylindrical wall during said rotating of said housing;

said means for selectively vibrating said cylindrical wall including a hammer device which has a first end and a head on said first end thereof; and said means for selectively vibrating said cylindrical wall including means for reciprocating at least said first end of said hammer device toward and away from said outer surface of said cylindrical wall to cause said head on said first end of said hammer device to make repeated, jarring contact in said continuous cylindrical band region of said cylindrical wall.

2. The improved ice measuring and dispensing machine as set forth in claim 1, wherein said hammer device includes a second end and an intermediate portion between said first end and said second end, said means for reciprocating said at least said first end of said hammer device includes a motor having a rotating crank arm, said hammer device is pivotally mounted at said second end, and said rotating crank is connected to said intermediate portion for reciprocating said intermediate portion and said first end of said hammer device about said second end thereof by said motor.

3. The improved ice measuring and dispensing machine as set forth in claim 2, wherein said motor has a speed of rotation and said means for reciprocating includes means for selectively varying said speed of rotation to selectively vary a rate of said jarring contact.

4. The improved ice measuring and dispensing machine as set forth in claim 2, wherein said ice supply hopper includes an outer wall and further including means for selectively vibrating said outer wall of said ice supply hopper, wherein said means for selectively vibrating said outer wall including an additional hammer device, said additional hammer device includes a first end and a head on said first end thereof, said means for selectively vibrating said outer wall includes means for reciprocating at least said first end of said additional hammer device toward and away from said outer wall to cause said head on said first end of said additional hammer device to make repeated, jarring contact with said outer wall.

5. The improved ice measuring and dispensing machine as set forth in claim 4, wherein said additional hammer device includes a second end and an intermediate portion between said first end and said second end, said means for reciprocating said at least said first end of said additional hammer device includes said motor having an additional rotating crank arm, said additional hammer device is pivotally mounted at said second end, and said additional rotating crank arm is connected to said intermediate portion of said additional hammer device for reciprocating said intermediate portion and said first end of said additional hammer device about said second end thereof by said motor.

6. The improved ice measuring and dispensing machine as set forth in claim 5, wherein said motor has a speed of rotation and said means for reciprocating at least said first end of said hammer device and at least said first end of said additional hammer device includes means for selectively varying said speed of rotation to selectively vary a rate of said jarring contact with said cylindrical wall and with said outer wall.

7. The improved ice measuring and dispensing machine as set forth in claim 1, wherein said ice supply hopper includes an outer wall and further including means for selectively vibrating said outer wall of said ice supply hopper, wherein said means for selectively vibrating said outer wall including an additional hammer device, said additional hammer device includes a first end and a head on said first end thereof, said means for selectively vibrating said outer wall includes means for reciprocating at least said first end of said additional hammer device toward and away from said outer wall to cause said head on said first end of said additional hammer device to make repeated, jarring contact with said outer wall.

8. The improved ice measuring and dispensing machine as set forth in claim 1, wherein said machine includes a frame and said means for selectively vibrating is removably secured to said frame of said machine.

9. The improved ice measuring and dispensing machine as set forth in claim 1, wherein said machine includes a housing drive means for said rotation of said rotating housing and said means for selectively vibrating said cylindrical wall is independent of said housing drive means.

10. The improved ice measuring and dispensing machine as set forth in claim 9, wherein said means for selectively vibrating said cylindrical wall is at a vibration rate which is independent of said predetermined speed.

11. The improved ice measuring and dispensing machine as set forth in claim 10, wherein said means for selectively vibrating said cylindrical wall includes means for selectively varying said vibration rate independent of said predetermined speed.

12. The improved ice measuring and dispensing machine as set forth in claim 1, further including a sound-dampened cabinet, wherein said means for selectively vibrating said cylindrical wall is disposed within said sound-dampening cabinet.

* * * * *